US008030265B2

(12) United States Patent
Walsh

(10) Patent No.: US 8,030,265 B2
(45) Date of Patent: Oct. 4, 2011

(54) COMPOSITION FOR REMOVING MINERAL DEPOSITS AND ETCHING FROM HARD SURFACES

(76) Inventor: Terence Walsh, Huntington, NY (US)

( * ) Notice: Subject to any disclaimer, the term of this patent is extended or adjusted under 35 U.S.C. 154(b) by 0 days.

(21) Appl. No.: 12/370,756

(22) Filed: Feb. 13, 2009

(65) Prior Publication Data

US 2009/0209448 A1 Aug. 20, 2009

Related U.S. Application Data

(60) Provisional application No. 61/028,981, filed on Feb. 15, 2008.

(51) Int. Cl.
*C11D 1/00* (2006.01)

(52) U.S. Cl. ..... 510/397; 51/307

(58) Field of Classification Search ..... 510/397; 51/307

See application file for complete search history.

(56) References Cited

U.S. PATENT DOCUMENTS 1,965,299 A * 7/1934 Patterson ..... 51/304
4,051,056 A 9/1977 Hartman
4,218,250 A 8/1980 Kasprzak
4,561,993 A 12/1985 Choy et al.
5,294,644 A * 3/1994 Login et al. ..... 514/698
5,443,604 A * 8/1995 Stowell ..... 51/307
5,697,991 A 12/1997 Frazer
6,528,070 B1 3/2003 Bratescu et al.
7,598,216 B2 * 10/2009 Schultz et al. ..... 510/417
2006/0105007 A1 5/2006 Narayanan et al.
2007/0209549 A1 9/2007 Hasinovic et al.

* cited by examiner

*Primary Examiner* — Milton I Cano
*Assistant Examiner* — M. Reza Asdjodi
(74) *Attorney, Agent, or Firm* — Carter, DeLuca, Farrell & Schmidt, LLP

(57) ABSTRACT

A composition and for removing mineral deposits and method of making the composition is provided which includes water, a fine abrasive, a plurality of petroleum distillate products, at least one polyalcohol, at least one fatty acid, at least one non-ionic surfactant and at least one semipolar solvent. Water is present at about 20-50 wt %, abrasive particles at about 10-35 wt %, petroleum distillates at about 10-35 wt %, polyalcohol at about 0.5-5 wt %, fatty acid at about 0.5-5 wt %, non-ionic surfactant at about 1-3 wt %, and semipolar solvent at about 0.1-1 wt %. A method of removing mineral deposits from a hard surface such as glass is provided which includes applying the aforesaid composition to a hard surface and removing the composition from the surface to remove mineral deposits from the surface.

14 Claims, 2 Drawing Sheets

COMPOSITION FOR REMOVING MINERAL DEPOSITS AND ETCHING FROM HARD SURFACES

CROSS REFERENCE TO RELATED APPLICATIONS

This application claims the benefit of U.S. Provisional Patent Application Ser. No. 61/028,981 filed Feb. 15, 2008, the entire contents of which are hereby incorporated by reference.

BACKGROUND

1. Technical Field

Cleaning and/or polishing compounds for use on hard surfaces to remove mineral deposits and etching.

2. Description of Related Art

Various products and techniques exist for cleaning and/or polishing hard surfaces such as glass and ceramics. See, e.g., U.S. Pat. Nos. 4,051,056, 4,218,250, 4,561,993, and 5,443,604. Such hard surfaces typically are exposed to conditions which result in the deposit of mineral deposits and other detrimental materials that mar their surfaces.

There are situations where chemical changes to the surfaces have occurred and it is considered difficult, if not impossible, to restore the surface to its original condition. For example, streaky or milky-colored stains on shower doors are often permanent because the glass has been etched by the reaction of water-borne chemicals. These can be prevented through the installation of water softening equipment or by simply wiping the doors dry after use. However, daily compliance with preventative procedures is often difficult. Hard water facilitates scum, film, and lime deposits on a number of household surfaces. These unattractive deposits can appear on china, porcelain, enamel, tile, stainless steel, fiberglass, chrome, and glass surfaces. Hard water increases films and stains from soaps, minerals, and other substances. Bathroom fixtures, sinks, dishes, and other surfaces need more frequent cleaning. Exterior glass plates, e.g., windows, building panels, etc., are frequently exposed to environmental conditions which also create unsightly mineral deposits and etching. Likewise, automobile windshields are frequently marred by acid rain and other road grime.

Calcium and magnesium in water can leave hard deposits referred to as lime scales on hard surfaces. These minerals make cleaning products less effective. To clean away lime scale, cleaning products with sequestrants are used to clean lime scale by capturing and deactivating minerals in water. The deactivated minerals then cannot react with other materials to form scum, film, or lime scale.

As mentioned above, hard surfaces such as glass which have been soiled by mineral deposits and/or etching are difficult to clean and restore to their original luster. Abrasive pastes and powders such as rouge may be used to clean and polish glass. Effective use of these materials typically involves labor intensive techniques which include polishing machines. Powders are messy and cleaning up after their use is time consuming and difficult. Most popular commercially available glass cleaners are completely ineffective in removing mineral deposits and other strongly bound constituents to glass.

There exists a need for effective, easy to use cleaners and polishes for use on hard surfaces.

SUMMARY

A composition is provided which includes water, a fine abrasive, a plurality of petroleum distillate products, at least one polyalcohol, at least one fatty acid, at least one non-ionic surfactant and at least one semipolar solvent. In terms of weight percent, water is present at about 20-50%, abrasive particles—10-35%, petroleum distillates—10-35%, polyalcohol—0.5-5%, fatty acid—0.5-5%, non-ionic surfactant—1-3%, and semipolar solvent—0.1%-1%. A method of cleaning glass is provided which includes applying the aforesaid composition to a glass surface and removing the composition from the glass to provide cleaned glass. A method of removing mineral deposits from a hard surface is provided which includes applying the aforesaid composition to a hard surface and removing the composition from the surface to remove mineral deposits from the surface.

DETAILED DESCRIPTION OF PREFERRED EMBODIMENTS

Figure 1:
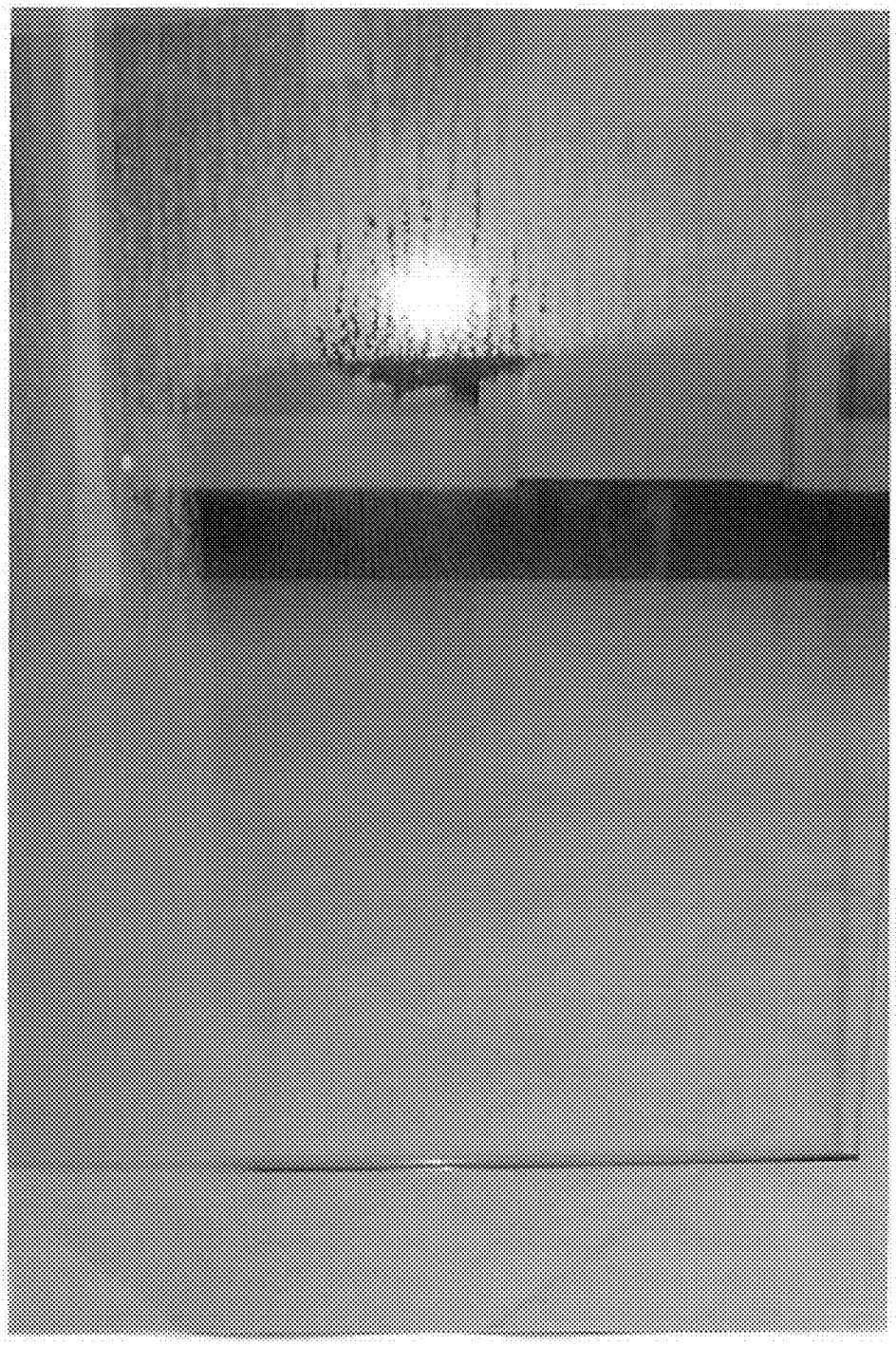
FIG. 1 depicts an image of a glass shower door having a portion treated with existing commercially available cleaners and another portion treated with a composition according to the present invention.

The cleaning and polishing composition herein includes water, a fine abrasive, a plurality of petroleum distillate products, at least one polyalcohol, at least one fatty acid, at least one non-ionic surfactant and at least one semipolar solvent. In terms of weight percent, water is present at about 20-50%, abrasive particles—about 10-35%, petroleum distillates—about 10-35%, polyalcohol—about 0.5-5%, fatty acid—about 0.5-5%, non-ionic surfactant—about 1-3%, and semipolar solvent—about 0.1%-1%. Depending on the amount of abrasive and/or fatty acid, the consistency of the composition can range from cream to viscous liquid. Preservatives, perfumes and coloring agents may optionally be included.

The composition is extremely effective in removing mineral deposits and surface etching from glass, ceramics, and metals such as chrome, with surprising ease. There is no need for automated polishing devices such as buffers. The composition is preferably applied with a foam, sponge or textile applicator by rubbing the composition onto the surface to be cleaned. Abrasive pads or sponges may be used with the composition to remove heavy build up of deposits. After rubbing the composition on the surface, it is advantageous to allow a short period of time to elapse, e.g., 1-3 minutes prior to removing the composition. A towel or sponge can be used to wipe the surface clean. Preferably, the composition may be applied to portions of the entire surface to be cleaned, e.g., two foot by two foot sections, which are sequentially treated with the composition. Use of the composition unexpectedly removes streaky or milky-colored stains on such hard surfaces which have been caused by mineral build-up and etching.

The preferred abrasive is a particulate material having a size generally ranging from about 1 to about 10 μm. Smaller size particles may also be present. Especially preferred is tripoli, a fine-grained crystalline silica in various stages of aggregation. Grain sizes range from about 1-10 μm, but particles as small as about 0.1 to 0.2 μm may be present. Other abrasives may also be used such as diatomaceous earth within the preferred size range. The abrasive particles are mixed with the other ingredients, preferably starting with the petroleum distillate products. The petroleum distillates facilitate uniform dispersion of the abrasive material and ensures effective, continuous lubrication of the surface during cleaning and mineral removal. It keeps the composition workable by helping to prevent drying of the composition as the water and mineral spirits evaporate during application.

Preferably, a blend of petroleum distillate lubricants of different molecular weights is used, including at least one of the following or similar compositions: heavy naphthenic hydrotreated petroleum distillates such as those contained in the composition having Chemical Abstracts Service Registry No. (hereinafter, CAS No.) 64742-48-9, mineral spirits such as hydrotreated light petroleum distillates (CAS No. 64742-47-8), aliphatic petroleum distillates such as Stoddard solvent (CAS No. 8052-41-3), and solvent refined heavy paraffinic petroleum distillates (CAS No. 64741-88-4). It will be understood that compositions with similar viscosity and wetting characteristics may be used if desired. Preferably, the composition includes approximately 8-30 wt % hydrotreated light petroleum distillates, approximately 0.5-5 wt % aliphatic petroleum distillates, approximately 0.5-5 wt % heavy hydrotreated naphthenic petroleum distillates, and approximately 0.5-5 wt % solvent refined heavy paraffinic petroleum.

The mineral spirits component facilitates mixing and dispersion of the other ingredients, including the abrasive component. It penetrates to the surface of the workpiece, assuring complete wetting of the surface so the composition readily spreads into small surface scratches and blemishes. It also dissolves surface grease and removes dirt on the surface. The mineral spirits preferably includes at least approximately 95 wt. % hydrotreated petroleum distillates such as those in the compositions having CAS Nos. 64752-46-7, 64742-47-8, and 64742-53-6. However, any convenient mixture of hydrotreated petroleum distillates having the desired wetting properties may be used.

The water (about 20-50 wt %) dilutes the composition to the desired consistency and serves as a carrier for the other ingredients. Polyhydric alcohols such as glycerin are present at approximately 0.5-5 wt %. Propyl alcohol (about 0.1-1 wt %) functions as a cosolvent. Oleic acid (about 0.5-5 wt %) aids as a spreading agent. The non-ionic surfactant provides for a smooth composition by aiding solubility of the composition's components and acts to suspend dirt and other components which are removed from the hard surface during cleaning. Preferred surfactants (about 1-3 wt %) are lauryl dimethylene oxide (CAS No. 1643-20-5) and C12-14 secondary ethoxylated alcohols (CAS No. 84133-50-6). Other optional ingredients which may be found in relatively small amounts include mineral oil (spreading agent) (less than about 2 wt %), a preservative, e.g., 2-hydroxymethylamino ethanol (less than about 0.2 wt %) and benzene (less than about 0.005 wt %). Although a composition having the above-listed ingredients outside the preferred ranges would have some cleaning and/or polishing action, a preferred composition is based upon optimum results attained by following the preferred embodiments.

In a preferred embodiment, a paste is mixed with a diluent to formulate a composition according to the present invention. The paste preferably contains the following components and is commercially available from 3M Co., 3M Center, St. Paul, Minn., under the brand Imperial™ Paste:

| | C.A.S. No. | % by weight |
|---|---|---|
| Water | 7732-18-5 | 15-40 |
| Tripoli (crystalline silica) | 1317-95-9 | 15-40 |
| Hydrotreated light petroleum distillates | 64742-47-8 | 10-30 |
| Glycerin | 56-81-5 | 1-5 |

-continued

| | C.A.S. No. | % by weight |
|---|---|---|
| Stoddard solvent | 8052-41-3 | 1-5 |
| Solvent-refined heavy paraffinic petroleum distillates | 64741-88-4 | 1-5 |
| Oleic acid | 112-80-1 | 1-5 |
| Mineral oil | 64741-89-5 | <2 |
| 2-hydroxymethylamino-ethanol | 34375-28-5 | <0.2 |
| Benzene | 71-43-2 | <0.005 |

A preferred diluent is commercially available from 3M Co., 3M Center, St. Paul, Minn., under the designation "Prep Solvent" and contains the following components:

| | C.A.S. No. | % by weight |
|---|---|---|
| Water | 7732-18-5 | 60-90 |
| Lauryldimethylamine oxide | 1643-20-5 | 7-13 |
| Alcohols, C12-14-secondary, ethoxylated | 84133-50-6 | 1-5 |
| Hydrotreated heavy naphtha (petroleum) | 64742-48-9 | 1-5 |
| Propyl alcohol | 71-23-8 | 1-5 |

In a preferred embodiment, the composition contains about 70-90 volume percent of the aforesaid paste and about 10-30 volume percent of the aforesaid diluent. Even more preferred is about 85-90 volume percent paste and about 10-15 volume percent diluent.

The composition may be prepared by slowly adding the diluent to the paste while stirring to form a smooth, uniformly-blended mixture. The diluent disperses the abrasive paste to produce a smooth, uniformly blended mixture. Because the abrasive particles are uniformly dispersed throughout the composition, scratching due to settling or clumping is largely eliminated. The amount of abrasive paste in the composition may vary within the preferred range given above (80-90 volume percent). For any given amount of the liquid ingredients, a lesser admixture of paste results in a thinner composition. Conversely, the more paste, the thicker the composition. However, if too much paste is used, the viscosity of the composition is too high and it is less easy to use.

As will be evident to one of ordinary skill, the proportions of the ingredients may readily be varied within the ranges set forth in accordance with the particular application. Coloring agents may be added to modify the appearance of the composition, or stabilizing agents to prolong its shelf life.

The following examples are included for purposes of illustration only. They should not be construed as limiting the scope of the invention.

COMPARATIVE EXAMPLES

Commercially available cleaners were applied to glass and results compared to a composition according to the present invention. FIG. 1 depicts a shower door treated with the following commercially available products: COMET® scouring powder (available from Prestige Brands, Inc.), LIME-A-WAY® (available from Reckitt-Benckiser, Nev.), TILEX® (available from the Clorox Company), SOFT SCRUB® (available from Henkel Consumer Goods, Inc.), CLR® (available from State Industrial Products, Inc.), WD-40® (commercially available from WD-40 Manufacturing Company, Inc.), and KABOOM® (commercially available from Church & Dwight, Inc.). The shower door had been marred by mineral deposits from regular use over time. Each of the afore-listed products was applied by hand rubbing the entire surface. After application and removal of each cleanser, the entire glass remained translucent and mottled. A composition containing about 15 volume percent "Prep Solvent" (3M) and about 85 volume percent Imperial™ paste (3M) was applied to approximately two-thirds of the visible glass surface by hand rubbing it on the glass with a lint-free towel. As can be seen from FIG. 1, the portion treated by the commercially available cleaners is translucent and mottled. The portion treated with the composition according to the present invention was cleaned of substantially all mineral deposits and is transparent.

Figure 2:
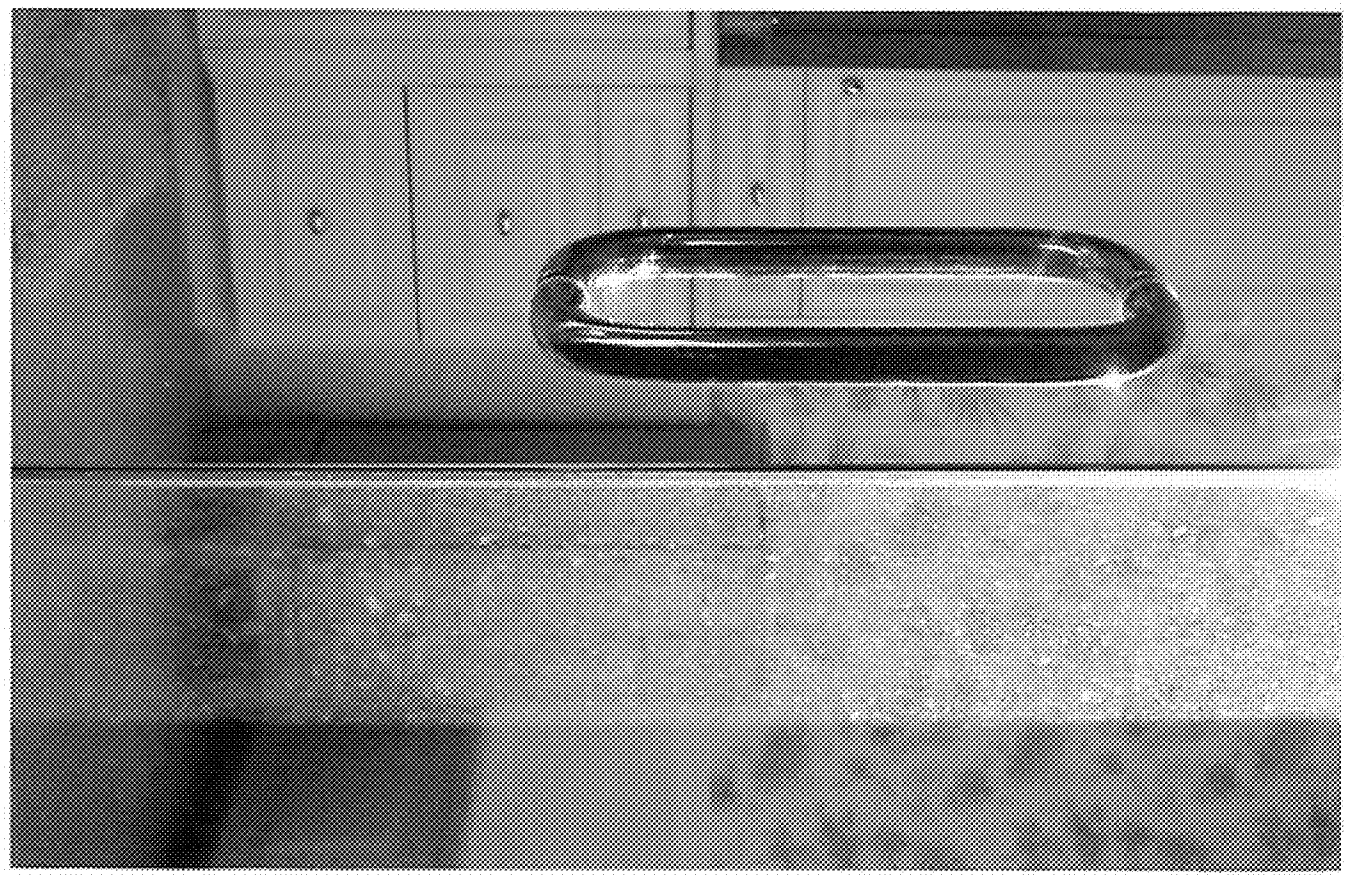
FIG. 2 depicts an image of a glass shower enclosure having a portion treated with existing commercially available cleaners and another portion treated with a composition according to the present invention.

FIG. 2 depicts a portion of a glass shower enclosure including a portion of a shower door and a portion of a side panel treated with the following commercially available products: gasoline, phosphoric acid, chlorine bleach, MR. CLEAN MAGIC ERASER® (available from Procter & Gamble Co.), COMET® scouring powder (available from Prestige Brands, Inc.), LIME-A-WAY® (available from Reckitt-Benckiser, Nev.), TILEX® (available from the Clorox Company), SOFT SCRUB® (available from Henkel Consumer Goods, Inc.), CLR® (available from State Industrial Products, Inc.), WD-40® (commercially available from WD-40 Manufacturing Company, Inc.), and KABOOM® (commercially available from Church & Dwight, Inc.). Each of the afore-listed products was applied by hand rubbing onto the entire surface. After application and removal of each cleanser, the entire glass remained translucent and mottled. A composition containing about 15 volume percent "Prep Solvent" (3M) and about 85 volume percent Imperial™ paste (3M) was applied to approximately four-fifths of the visible glass surface by hand rubbing it on the glass with a lint-free towel. As can be seen from FIG. 2, the portion treated by the commercially available cleaners remained translucent and mottled. The portion treated with the composition according to the present invention was cleaned of substantially all mineral deposits and is transparent.

It should be understood that variations can be made to the above embodiments that are with the purview of ordinary skill in the art. For example, other polyols such as mannitol or sorbitol can be used. Non-ionic surfactants are well-known and include, e.g., ethoxylated alkyl phenols (TERGITOL™ and TRITON™ from Union Carbide Corporation, Danbury, Conn.), TWEEN™ and SPAN™ surfactants. Semipolar solvents other than propyl alcohol such as ethanol may be used. Accordingly, those skilled in the art can envision modifications which are included within the scope of the claimed invention that are not expressly set forth herein.

What is claimed is:

1. A composition for removing mineral deposits consisting essentially of about 20% to about 50% by weight water; about 10% to about 35% by weight of a fine abrasive; about 10% to about 35% by weight of a plurality of petroleum distillate products, the petroleum distillate products selected from the group consisting of heavy naphthenic hydrotreated petroleum distillates, mineral spirits, aliphatic petroleum distillates and solvent refined heavy paraffinic petroleum distillates; about 0.5% to about 5% by weight of at least one polyhydric alcohol; about 1% to about 3% by weight of at least one fatty acid; about 1% to about 3% by weight of at least one non-ionic surfactant the nonionic surfactant selected from the group consisting of laurvldimethylene oxide, C12-14 secondary ethoxylated alcohols and a combination thereof; and about 0.1% to about 1% by weight of at least one semipolar solvent.

2. The composition for removing mineral deposits according to claim 1 wherein the abrasive is a particulate material ranging in size from about 1 μm to about 10 μm.

3. The composition for removing mineral deposits according to claim 2 wherein the abrasive is tripoli.

4. The composition for removing mineral deposits according to claim 1 wherein the mineral spirits are hydrotreated light petroleum distillates and the aliphatic petroleum distillate is Stoddard solvent.

5. The composition for removing mineral deposits according to claim 1 wherein the petroleum distillate products include from about 8-30 wt % hydrotreated light petroleum distillates, about 0.5-5 wt % aliphatic petroleum distillates, about 0.5-5 wt % heavy hydrotreated naphthenic petroleum distillates, and about 0.5-5 wt % solvent refined heavy paraffinic petroleum distillates.

6. The composition for removing mineral deposits according to claim 1 wherein the polyhydric alcohol is glycerin.

7. The composition for removing mineral deposits according to claim 1 wherein the fatty acid is oleic acid.

8. The composition for removing mineral deposits according to claim 1 wherein the semipolar solvent is propyl alcohol.

9. The composition for removing mineral deposits according to claim 1 further comprising an adjuvant selected from the group consisting of a spreading agent, a preservative, an organic solvent and combinations thereof.

10. A method for removing mineral deposits from a hard surface comprising applying a composition of claim 1 to a hard surface containing mineral deposits and removing the composition from the surface to remove mineral deposits from the surface.

11. A composition consisting essentially of:

about 20% to about 50% by weight water;
about 10% to about 35% by weight tripoli;
about 8% to about 30% by weight hydrotreated light petroleum distillates;
about 1% to about 3% by weight lauryldimethylene oxide;
about 0.5% to about 5% by weight stoddard solvent;
about 0.5% to about 5% by weight glycerin;
about 0.5% to about 5% by weight solvent refined heavy paraffinic petroleum distillates;
about 0.5% to about 5% by weight oleic acid;
about 0.1% to about 1% by weight C12-14 secondary ethoxylated alcohols;
about 0.1% to about 1% by weight heavy hydrotreated naphthenic petroleum distillates; and
about 0.1% to about 1% by weight propyl alcohol.

12. The composition according to claim 11 further comprising up to about 2% by weight mineral oil.

13. The composition according to claim 11 further comprising up to about 0.2% by weight 2-hydroxymethylamino ethanol.

14. The composition according to claim 11 further comprising up to about 0.005% by weight benzene.

* * * * *